US005732757A

United States Patent [19]

Mariol

[11] Patent Number: 5,732,757

[45] Date of Patent: Mar. 31, 1998

[54] SLOTTED PANEL AND STRAP COMBINATION

[75] Inventor: John V. Mariol, Cincinnati, Ohio

[73] Assignee: JVM Innovation & Design LLC, Cincinnati, Ohio

[21] Appl. No.: 644,379

[22] Filed: May 10, 1996

[51] Int. Cl.[6] ..... A47G 5/00

[52] U.S. Cl. ..... 160/135; 160/229.1; 160/231.1; 211/195; 16/225; 16/267

[58] Field of Search ..... 160/135, 229.1, 160/231.1; 211/195, 198; 16/225, 227, 267, 268

[56] References Cited

U.S. PATENT DOCUMENTS

| | | | |
|---|---|---|---|
| 1,944,696 | 1/1934 | Reichl | 160/135 |
| 2,526,129 | 10/1950 | Groesbeck et al. | 16/150 |
| 3,132,432 | 5/1964 | Yee | 160/135 X |
| 3,516,115 | 6/1970 | Koleske | 16/225 |
| 3,574,306 | 4/1971 | Alden | 16/225 X |
| 3,695,330 | 10/1972 | Hasbrouck | 160/135 |
| 4,163,303 | 8/1979 | Hanna | 16/135 |
| 4,344,475 | 8/1982 | Frey | 160/135 |
| 4,438,605 | 3/1984 | DeLucia | 16/225 X |
| 4,506,408 | 3/1985 | Brown | 16/225 |
| 4,619,304 | 10/1986 | Smith | 160/135 |
| 4,658,472 | 4/1987 | Grenier | 16/225 |
| 4,843,679 | 7/1989 | Maidment et al. | 16/227 |
| 5,039,177 | 8/1991 | Newell et al. | 160/135 X |
| 5,148,850 | 9/1992 | Urbanick | 160/229.1 X |
| 5,155,855 | 10/1992 | Lindblom et al. | 160/135 |
| 5,367,744 | 11/1994 | Ahlberg et al. | 16/227 |
| 5,588,180 | 12/1996 | Chester | 16/225 |

FOREIGN PATENT DOCUMENTS

| | | | |
|---|---|---|---|
| 267025 | 7/1961 | Netherlands | 16/225 |
| 2257198 | 1/1993 | United Kingdom | 16/225 |

*Primary Examiner*—Kenneth J. Dorner
*Assistant Examiner*—Bruce A. Lev
*Attorney, Agent, or Firm*—Dressler, Rockey, Milnamow & Katz, Ltd.

[57] ABSTRACT

A first panel is hinged to a second panel by first, second, and third straps, which are flexible. Each strap is secured to the first panel, near a first end of such strap, and to the second panel, near a second end of such strap. Each strap passes through a slot of the first panel, partly around an edge portion of the first panel, partly around an edge portion of the second panel, and through a slot in the second panel. The first and second straps pass in generally opposite directions between the edge portions of the first and second panels so as to appear to cross each other when viewed along the edge portions thereof. The second and third straps pass in generally opposite directions between the edge portions of the first and second panels so as to appear to cross each other when viewed along the edge portions thereof. The respective straps are made from a stretchable, resilent, polymeric material and are secured to the first and second panels by buttons formed unitarily with such panels or provided by fasteners, the buttons passing through holes in such straps, or by interengaged formations on such straps and on such panels.

4 Claims, 2 Drawing Sheets

SLOTTED PANEL AND STRAP COMBINATION

TECHNICAL FIELD OF THE INVENTION

This invention pertains to a novel combination comprising a first panel, a second panel, and at least one strap for strapping the first and second panels to each other. Two, three, or more straps may be employed. Each strap passes through a slot of the first panel, partly around an edge portion of the first panel, partly around an edge portion of the second panel, and through a slot in the second panel. The novel combination is useful in juvenile furniture, room partitions, and other similar and dissimilar applications.

BACKGROUND OF THE INVENTION

As exemplified in Hasbrouck U.S. Pat. No. 3,695,330, Hanna U.S. Pat. No. 4,163,303, Smith U.S. Pat. No. 4,619,304, and Maidment et al. U.S. Pat. No. , 4,843,679, it has been known heretofore to employ flexible straps to hinge two panels or other structures to each other. As exemplified therein, various crimping or clamping means, hook-and-loop fasteners, and other means have been known for fastening the straps to the panels or other structures.

SUMMARY OF THE INVENTION

This invention provides a novel combination comprising a first panel, a second panel, and means for strapping the first and second panels to each other. Each panel has a main portion, an edge portion, and a slotted region between the main and edge portions. The strapping means comprises at least one flexible strap having a first end and a second end, secured to the first panel, near the first end, passing through the slotted region of the first panel, partly around the edge portion of the first panel, between the edge portions of the first and second panels, partly around the edge portion of the second panel, and through the slotted region of the second panel, and secured to the second panel, near the second end.

Preferably, the strapping means comprises a first strap and a second strap, each as described above. More preferably, the hinging means comprises a first strap, a second strap, and a third strap, each as described above. In either instance, the first and second straps pass in generally opposite directions between the edge portions of the first and second panels so as to appear to cross each other when viewed along the edge portions of the first and second panels. If the third strap is employed, the second and third straps pass in generally opposite directions between the edge portions of the first and second panels so as to appear to cross each other when viewed along the edge portions of the first and second panels. More straps may be similarly employed.

If each strap is made from a stretchable, resilient, polymeric material, and if each strap has at least one hole near the first end and at least one hole near the second end, each panel may be provided with similar buttons. Thus, one of the buttons of the first panel may be passed through the hole near the first end of each strap. Also, another of the buttons of the second panel may be passed through the hole near the second end of each strap. The buttons of each panel may be formed unitarily with such panel or may be provided by fasteners having heads providing the buttons and having shanks pressed into holes in such panel. If such buttons are not employed, each strap may be secured to each panel by interengagement of interengageable formations on such strap and on such panel.

These and other objects, features, and advantages of this invention are evident from the following description of a preferred embodiment of this invention and several alternative embodiments thereof with reference to the accompanying drawings.

DETAILED DESCRIPTION OF ILLUSTRATED EMBODIMENTS

Figure 1:
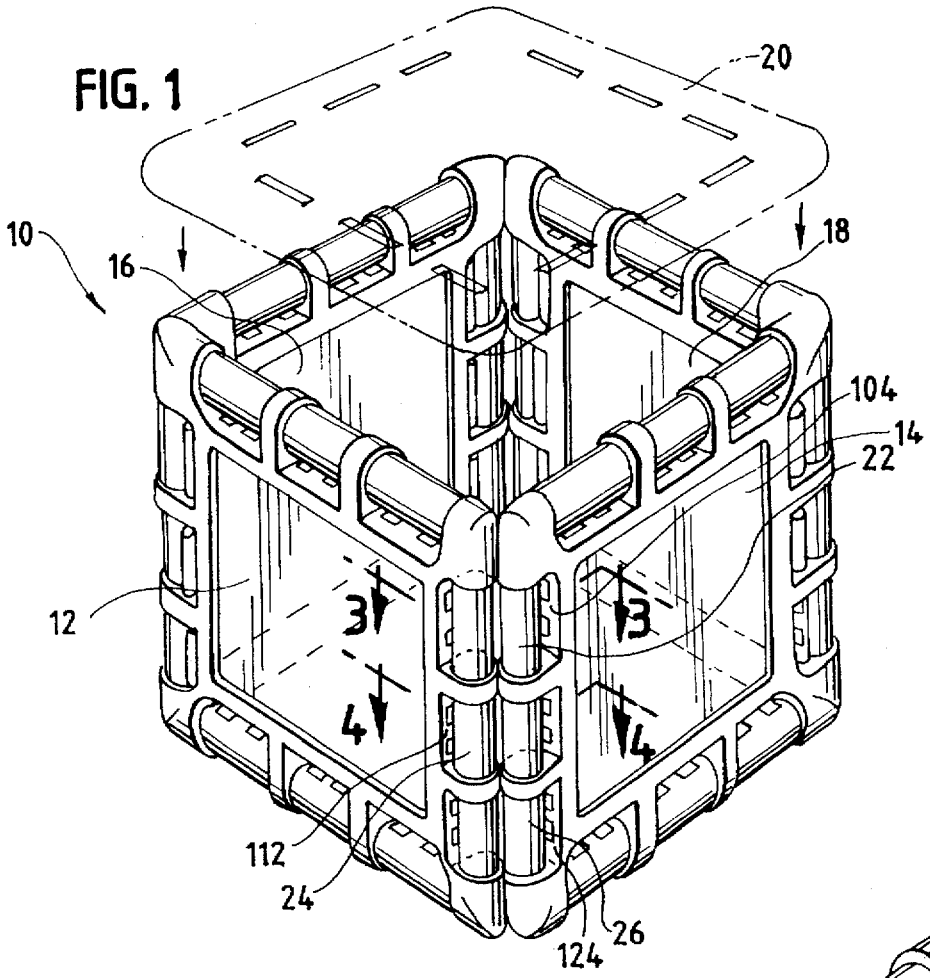
FIG. 1 is a perspective view of a box assembled from several panels, which are strapped to one another in a novel combination constituting a preferred embodiment of this invention.

As shown in FIG. 1, a box 10 comprises four side panels, which are similar to one another, namely a first panel 12, a second panel 14, a third panel 16, and a fourth panel 18, which strapped to one another in a novel combination constituting a preferred embodiment of this invention. The respective panels are molded, as by blow molding, from a substantially rigid, polymeric material, such as high density polyethylene.

Figure 2:
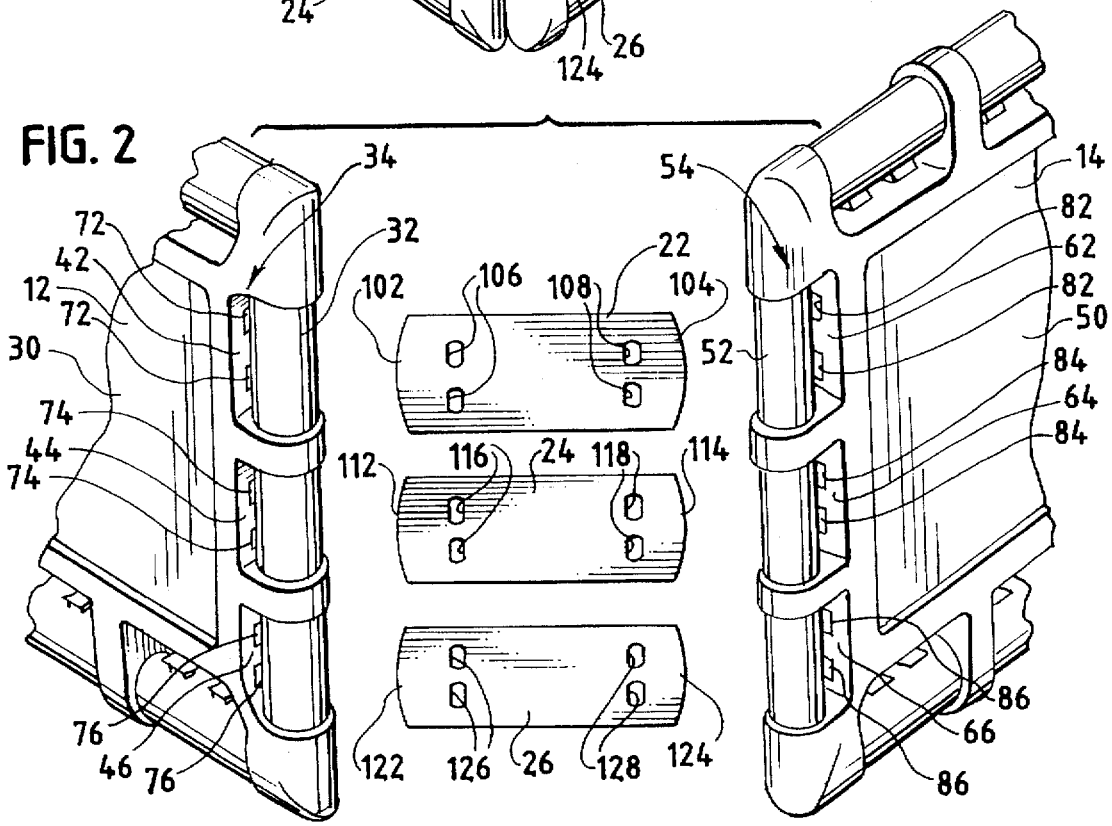
FIG. 2, on a larger scale, is an exploded view of a first panel of the box, a second panel of the box, and three flexible straps, which are used to hinge the first and second panels to each other at a comer of the box.
Figure 3:
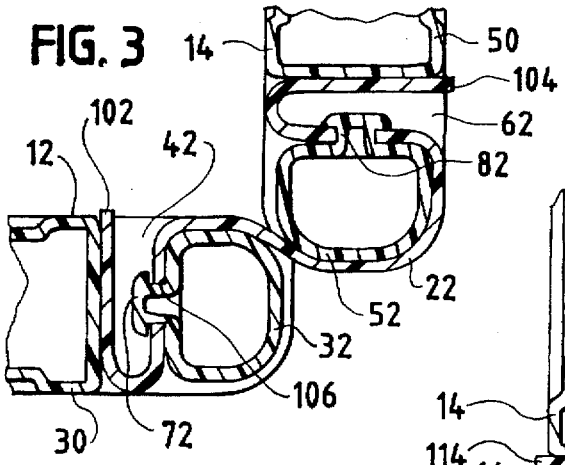
FIG. 3, on a further enlarged scale, is a sectional view taken along line 3—3 of FIG. 1, in a direction indicated by arrows.
Figure 4:
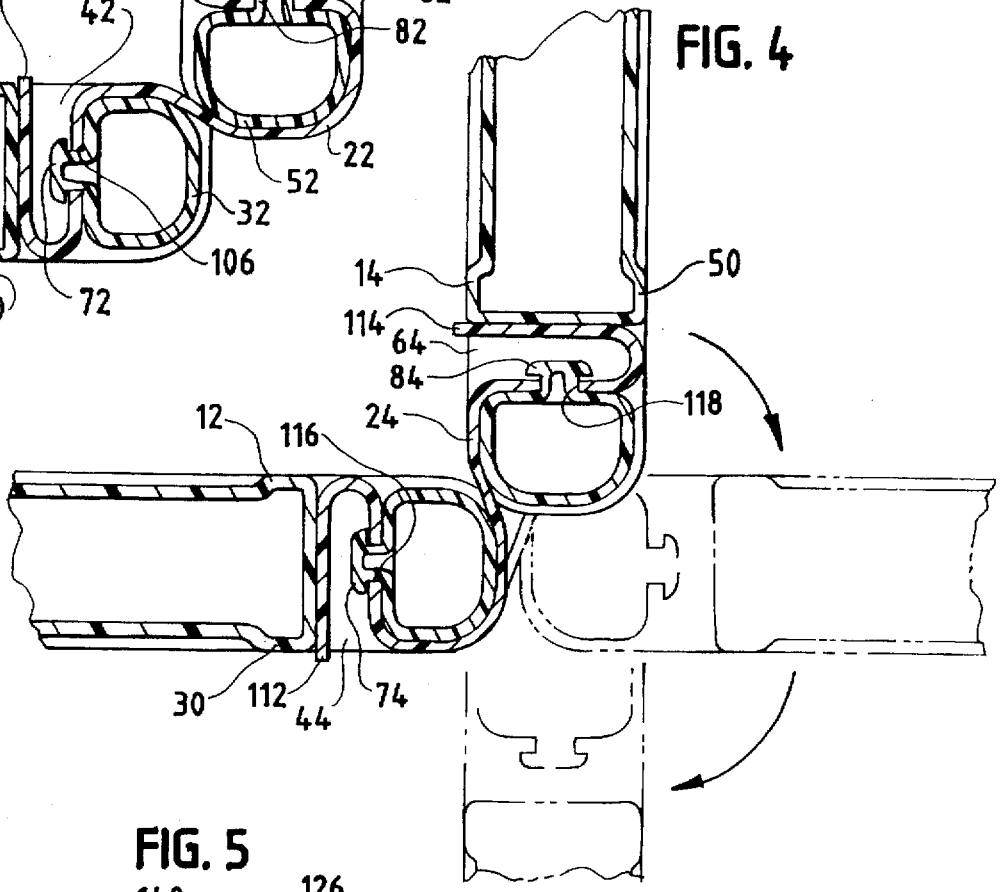
FIG. 4, on a similarly enlarged scale, is a sectional view taken along line 4—4 of FIG. 1, in a direction indicated by arrows.

As shown in FIGS. 2, 3, and 4, the first panel 12 and the second panel 14 are strapped to each other by three flexible straps, namely a first strap 22, a second strap 24, and a third strap 26. The second panel 14 and the third panel 16 are strapped to each other by three similar straps. The third panel 16 and the fourth panel 18 are strapped similarly to each other by three similar straps. The fourth panel 18 and the first panel 12 are strapped similarly to each other by three similar straps. The respective straps are die-cut from a sheet of a stretchable, resilient, polymeric material, such as low density polyethylene.

As shown in broken lines in FIG. 1, the box 10 also may comprise a top panel 20 (shown in broken lines) which may be similarly molded and which may be similarly strapped to one or more of the side panels noted above. If strapped similarly to only one of the side panels, the straps (not shown) strapping the top panel 20 thereto function to hinge the top panel 20 thereto. The box 10 also may comprise a bottom panel (not shown) which may be similarly molded and which may be similarly strapped to the side panels noted above.

As shown in FIG. 1 and other views, each of the side panels 12, 14, 16, 18, has a main portion, an edge portion along each of its four edges, and a slotted region including three aligned slots between the main portion and each of the edge portions. Thus, the first panel 12 has a main portion 30, an edge portion 32 where the first panel 12 and the second panel 14 are strapped to each other, and a slotted region 34 between the main portion 30 and the edge portion 32. The slotted region 34 includes a first slot 42 for the first strap 22, a second slot 44 for the second strap 24, and a third slot 46 for the third strap 26. The edge portion 32 is rounded in outer cross-section (see FIGS. 3 and 4) near the respective slots 42, 44, 46. Also, the second panel 14 has a main portion 50, an edge portion 52 where the first panel 12 and the second panel 14 are strapped to each other, and a slotted region 54 between the main portion 50 and the edge portion 52. The slotted region 54 includes a first slot 62 for the first strap 22, a second slot 64 for the second strap 24, and a third slot 66 for the third strap 26. The edge portion 52 is rounded so as to be generally oval in outer cross-section (see FIGS. 3 and 4) near the slots 62, 64, 66.

The first panel 12 has six similar buttons molded unitarily on the edge portion 32 and facing toward the main portion 30, namely two buttons 72 within the first slot 42, two buttons 74 within the second slot 44, and two buttons 76 within the third slot 46. The second panel 14 has six similar buttons molded unitarily on the edge portion 32 and facing toward the main portion 30, namely two buttons 82 within the first slot 62, two buttons 84 within the second slot 64, and two buttons 86 within the third slot 66.

The first strap 22 has a first end 102, a second end 104, two holes 106 near the first end 102, and two holes 108 near the second end 104. The second strap 24 has a first end 112, a second end 114, two holes 116 near the first end 112, and two holes 118 near the second end 114. The third strap 26 has a first end 122, a second end 124, two holes 126 near the first end 122, and two holes 128 near the second end 124.

When the first panel 12 and the second panel 14 are assembled, the buttons 72 of the first panel 12 are passed through the holes 106 near the first end 102 of the first strap 22, which can be resiliently stretched to enable the buttons 72 to pass through the holes 106. Next, the first strap 22 is passed through the first slot 42 of the first panel 12, partly around the edge portion 32 of the first panel 12 where the edge portion 32 is rounded, between the edge portion 32 of the first panel 12 and the edge portion 52 of the second panel 14, partly around the edge portion 52 of the second panel 14 where the edge portion 52 is rounded, and through the first slot 62 of the second panel 14. Next, the buttons 82 of the second panel 14 are passed through the holes 108 near the second end 104 of the first strap 22, which can be resiliently stretched to enable the buttons 82 to pass through the holes 108. Beyond the holes 106, the first end 102 of the first strap 22 is folded over and is tucked into the first slot 42 of the first panel 12. Beyond the holes 108, the second end 104 of the first strap 22 is folded over and is tucked into the first slot 62 of the second panel 14.

Likewise, the buttons 74 of the first panel 12 are passed through the holes 116 near the first end 112 of the second strap 24, which can be resiliently stretched to enable the buttons 74 to pass through the holes 116. Next, the second strap 24 is passed through the second slot 44 of the first panel 12, partly around the edge portion 32 of the first panel 12 where the edge portion 32 is rounded, between the edge portion 32 of the first panel 12 and the edge portion 52 of the second panel 14, partly around the edge portion 52 of the second panel 14 where the edge portion 52 is rounded, and through the second slot 64 of the second panel 14. Next, the buttons 84 of the second panel 14 are passed through the holes 118 near the second end 114 of the second strap 24, which can be resiliently stretched to enable the buttons 84 to pass through the holes 118. Beyond the holes 116, the first end 112 of the second strap 24 is folded over and is tucked into the second slot 44 of the first panel 12. Beyond the holes 118, the second end 114 of the second strap 24 is folded over and is tucked into the second slot 64 of the second panel 14.

Likewise, the buttons 76 of the first panel 12 are passed through the holes 126 near the first end 122 of the third strap 26, which can be resiliently stretched to enable the buttons 76 to pass through the holes 126. Next,the third strap 26 is passed through the third slot 46 of the first panel 12, partly around the edge portion 32 of the first panel 12 where the edge portion 32 is rounded, between the edge portion 32 of the first panel 12 and the edge portion 52 of the second panel 14, partly around the edge portion 52 of the second panel 14 where the edge portion 52 is rounded, and through the second slot 64 of the second panel 14. Next, the buttons 86 of the second panel 14 are passed through the holes 128 near the second end 124 of the third strap 26, which can be resiliently stretched to enable the buttons 86 to pass through the holes 128. Beyond the holes 126, the first end 122 of the third strap 26 is folded over and is tucked into the third slot 46 of the first panel 12. Beyond the holes 128, the second end 124 of the third strap 26 is folded over and is tucked into the third slot 66 of the second panel 14.

As shown in FIG. 3, the first strap 22 and the second strap 24 pass in generally opposite directions between the edge portion 32 of the first panel 12 and the edge portion 52 of the panel 14 so as to appear to cross each other when viewed along the edge portions 32, 52. As shown in FIG. 4, the second strap 24 and the third strap 26 pass in generally opposite directions between the edge portion 32 of the first panel 12 and the edge portion 52 of the panel 14 so as to appear to cross each other when viewed along the edge portions 32, 52. The first strap 12 and the third strap 16 pass in generally similar directions between the edge portion 32 of the first panel 12 and the edge portion 52 of the panel 14. Consequently, the first panel 12 and the second panel 14 are hinged to each other so as to be relatively movable through a wide range of relative positions, which include but are not limited to their positions shown in full lines in FIG. 4, their positions shown in broken lines in FIG. 4, and other positions (not shown) wherein the first panel 12 is folded upon the second panel 14 or the second panel 14 is folded upon the first panel 12.

Figure 5:
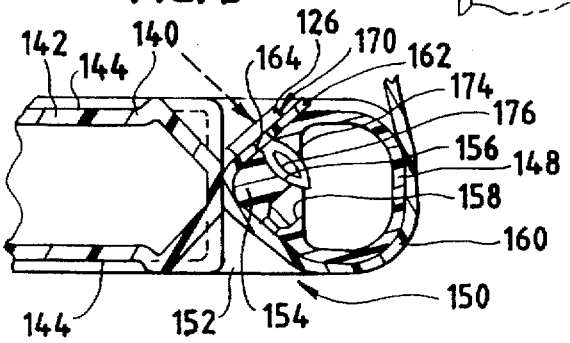
FIG. 5 is a sectional view showing one possible fastener useful as one alternative means for securing one end of each strap to one such panel.

In an alternative embodiment shown in FIG. 5, an exemplary panel 140 and an exemplary strap 160 having an exemplary end 162 with a hole 164 are shown. The panel 140 has a main portion 142 with two expansive surfaces 144, 146, an edge portion 148, and a slotted region 150 with a slot 152 for the strap 160. The panel 140 is similar to each of the side panels shown in FIGS. 1 through 4 and described above, except that the edge portion 148 where facing the slot 152 has a thickened region 154, which is provided with two similar sockets 156, 158, each opwning toward and defining an acute angle relative to a respective one of the expansive surfaces 144, 146.

As shown in FIG. 5, a fastener 170 of a known type is used to secure the strap 160, near the end 162, to the thickened region 154. The fastener 170 has a shank 174 passing through the hole 164 in the end 162 of the strap 160, into one such socket 156, and a head 176 retaining the end 162 of the strap 160. The strap 160 passes through the slot 152 in a given direction. The other socket 158 would be similarly used if the strap 160 were to pass through the slot 152 in an opposite direction. In a similar manner, a second fastener (not shown) may be also used to secure the strap 160, near the end 162, to the thickened region 154.

Figure 6:
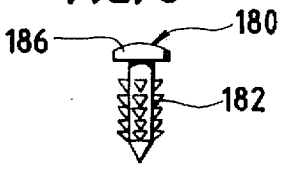
FIG. 6 is an elevational view of another fastener that can be alternatively used where the fastener of FIG. 5 is used.

As shown in FIG. 5, the shank 174 of the fastener 170 is bifurcated and has a cross aperture 178, which enables the shank 174 to be readily removable from whichever socket 156 is used without damage to the panel 140. As shown in FIG. 6, a fastener 180 having a barbed shank 182 and a head 186 could be alternatively used, whereby the shank 182 would not be readily removable.

Figure 7:
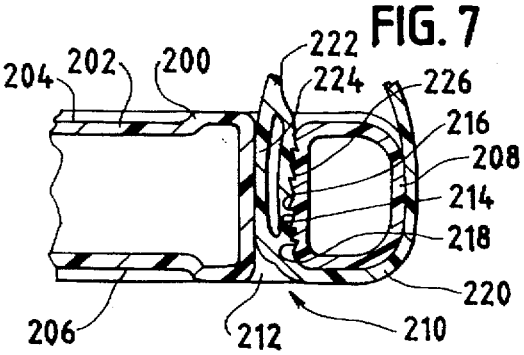
FIG. 7 is a sectional view showing another alternative means for securing one end of each strap to one such panel.

In an alternative embodiment shown in FIG. 7, an exemplary panel 200 and an exemplary strap 220 are shown. The panel 200 has a main portion 202 with two expansive surfaces 204, 206, an edge portion 208, and a slotted region 210 with a slot 212 for the strap 220. The panel 200 is similar to each of the side panels shown in FIGS. 1 through 4 and described above, except that the edge portion 208 has a grooved surface 214 facing the slot 212. The grooved surface 214 has a portion 216 near the expansive surface 204 and a portion 218 near the expansive surface 206.

As severed from an extruded blank of a suitable, stretchable, resilient, polymeric material, such as low density polyethylene, the strap 220 is formed unitarily at its first end 222 with a generally tubular formation 224 having a grooved surface 226 interengaged with the portion 216 of the grooved surface 214 so as to secure the first end of the strap 220 to the panel 200. The strap 220 passes through the slot 212 in a given direction. The portion 218 of the grooved surface 214 would be similarly employed to secure first end of a strap (not shown) passing through the slot 212 in an opposite direction.

Figure 8:
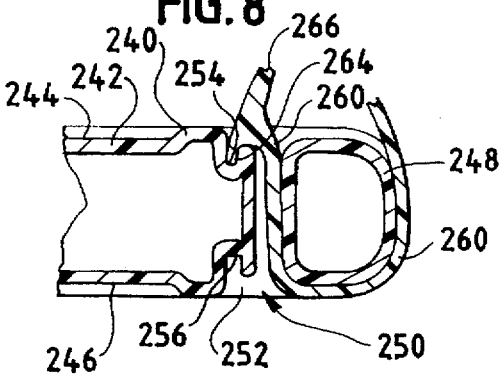
FIG. 8 is a sectional view showing another alternative means for securing one end of each strap to one such panel.

In an alternative embodiment shown in FIG. 8, an exemplary panel 240 and an exemplary strap 260 are shown. The panel 240 has a main portion 242 with two expansive surfaces 244, 246, an edge portion 248, and a slotted region 250 with a slot 252 for the strap 260. The panel 240 is similar to each of the side panels shown in FIGS. 1 through 4 and described above, except that the main portion 242 has a recess 254 opening toward the expansive surface 244 and a recess 256 opening toward the expansive surface 246. The recesses 254, 256, may extend entirely along the panel 240.

As severed from an extruded blank of a suitable, stretchable, resilient, polymeric material, such as low density polyethylene, the strap 260 is formed at its first end 262 with a hook 264 and with a tab 266 extending from the hook 264. The hook 264 is hooked into the recess 254 so as to secure the strap 260 to the panel 240. A stretchable, resilient, polymeric material being used for the strap 260, the strap 260 is stretched sufficiently to enable the hook 264 to be thus hooked into the recess 254. The strap 260 passes through the slot 252 in a given direction. The recess 256 would be similarly employed to secure the first end of a strap (not shown) passing through the slot 242 in an opposite direction.

Advantageously, in the preferred embodiment shown in FIGS. 1 through 4 and described above and the alternative embodiments shown in FIGS. 7 and 8 and described above, separate fasteners are not required for assembling and disassembling the respective panels and the respective straps.

Various modifications may be made in any of the foregoing embodiments without departing from the scope and spirit of this invention.

I claim:

1. A combination comprising a first panel, a second panel, and means for strapping the first and second panels to each other, wherein each panel has a main portion, an edge portion, and a slotted region between the main and edge portions, wherein the strapping means comprises at least one flexible strap having a first end and a second end, being secured to the first panel, near the first end, and to the second panel, near the second end, and passing through the slotted region of the first panel, partly around the edge portion of the first panel, between the edge portions of the first and second panel, partly around the edge portion of the second panel, and through the slotted region of the second panel, wherein said strap is secured to each panel by at least one button provided on said panel and passing through a corresponding hole in said strap, and wherein each strap is made from a stretchable, resilient, polymeric material so that said strap can be resiliently stretched to enable said button to pass through the corresponding hole in said strap.

2. A combination comprising a first panel, a second panel, and means for strapping the first and second panels to each other, wherein each panel has a main portion, an edge portion, and a slotted region between the main and edge portions, wherein the strapping means comprises a first flexible strap and a second flexible strap, each strap having a first end and a second end, being secured to the first panel, near the first end, and to the second panel, near the second end, and passing through the slotted region of the first panel, partly around the edge portion of the first panel, between the edge portions of the first and second panels, partly around the edge portion of the second panel, and through the slotted region of the second panel, the first and second straps passing in generally opposite directions between the edge portions of the first and second panels so as to appear to cross each other when viewed along the edge portions of the first and second panels, wherein each strap is secured to each panel by at least one button provided on said panel and passing through a corresponding hole in said strap, and wherein each strap is made from a stretchable, resilient, polymeric material so that said strap can be resiliently stretched to enable said button to pass through the corresponding hole in said strap.

3. A combination comprising a first panel, a second panel, and means for strapping the first and second panels to each other, wherein each panel has a main portion, an edge portion, and a slotted region between the main and edge portions, wherein the strapping means comprises a first flexible strap, a second flexible strap, and a third flexible strap, each strap having a first end and a second end, being secured to the first panel, near the first end, and to the second panel, near the second end, and passing through the slotted region of the first panel, partly around the edge portion of the first panel, between the edge portions of the first and second panels, partly around the edge portion of the second panel, and through the slotted region of the second panel, the first and second straps passing in generally opposite directions between the edge portions of the first and second panels so as to appear to cross each other when viewed along the edge portions of the first and second panels, the second and third straps passing in generally opposite directions between the edge portions of the first and second panels so as to appear to cross each other when viewed along the edge portions of the first and second panels, wherein each strap is secured to each panel by at least one button provided on said panel and passing through a corresponding hole in said strap, and wherein each strap is made from a stretchable, resilient, polymeric material so that said strap can be resiliently stretched to enable said button to pass through the corresponding hole in said strap.

4. The combination of claim 1, 2 or 3, wherein said button is molded unitarily with said panel from a substantially rigid, polymeric material.

* * * * *

UNITED STATES PATENT AND TRADEMARK OFFICE

CERTIFICATE OF CORRECTION

PATENT NO. : 5,732,757

DATED : March 31, 1998

INVENTOR(S) : John V. Mariol

It is certified that error appears in the above-indentified patent and that said Letters Patent is hereby corrected as shown below:

Column 6, line 5, first occurrence of "panel" should have been plural.

Signed and Sealed this

FourthDay of August, 1998

Bruce Lehman

*Attest:*

BRUCE LEHMAN

*Attesting Officer*

*Commissioner of Patents and Trademarks*